US009114853B1

(12) United States Patent
Apple et al.

(10) Patent No.: US 9,114,853 B1
(45) Date of Patent: Aug. 25, 2015

(54) WATERCRAFT WITH INTERCHANGEABLE HULL STRUCTURE

(71) Applicants: Thomas Apple, Suffolk, VA (US); David Pogorzelski, Chesapeake, VA (US); Elbert Adamos, Onancock, VA (US); Heidi Murphy, Virginia Beach, VA (US); Loc Nguyen, Ashburn, VA (US); Christopher Hart, Laurel, MD (US); Gary Shimozono, Kapolei, HI (US)

(72) Inventors: Thomas Apple, Suffolk, VA (US); David Pogorzelski, Chesapeake, VA (US); Elbert Adamos, Onancock, VA (US); Heidi Murphy, Virginia Beach, VA (US); Loc Nguyen, Ashburn, VA (US); Christopher Hart, Laurel, MD (US); Gary Shimozono, Kapolei, HI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/316,902

(22) Filed: Jun. 27, 2014

(51) Int. Cl.
*B63B 7/08* (2006.01)
*B63B 9/00* (2006.01)

(52) U.S. Cl.
CPC .. *B63B 7/082* (2013.01); *B63B 9/00* (2013.01)

(58) Field of Classification Search
CPC ..... B63B 7/082
USPC ..... 114/353, 345, 248
See application file for complete search history.

(56) References Cited

U.S. PATENT DOCUMENTS

| | | | | | |
|---|---|---|---|---|---|
| 4,597,355 | A * | 7/1986 | Kirby | 114/345 |
| 4,779,555 | A * | 10/1988 | Hong | 114/345 |
| 4,976,213 | A * | 12/1990 | Smith | 114/345 |
| 5,027,735 | A * | 7/1991 | Labrador | 114/39.26 |
| 5,131,348 | A * | 7/1992 | Roy | 114/363 |
| 5,184,564 | A * | 2/1993 | Robbins et al. | 114/345 |
| 5,228,407 | A * | 7/1993 | Cummer et al. | 114/345 |
| 6,006,691 | A * | 12/1999 | Wilce | 114/353 |
| 6,024,042 | A * | 2/2000 | Eilert | 114/355 |
| 6,135,047 | A * | 10/2000 | Miller | 114/343 |
| 6,164,238 | A * | 12/2000 | Stokes | 114/353 |
| 6,192,822 | B1 * | 2/2001 | Lavorata et al. | 114/345 |
| 6,223,677 | B1 * | 5/2001 | Hall et al. | 114/345 |
| 6,367,405 | B1 * | 4/2002 | Smiley | 114/353 |
| 6,460,477 | B1 * | 10/2002 | Hamilton et al. | 114/345 |
| 6,615,762 | B1 * | 9/2003 | Scott | 114/353 |
| 6,810,827 | B2 * | 11/2004 | Hansen | 114/345 |
| 8,656,855 | B2 * | 2/2014 | Flood et al. | 114/347 |
| 8,678,868 | B2 * | 3/2014 | Bailey et al. | 440/11 |
| 2006/0096517 | A1 * | 5/2006 | Durand et al. | 114/345 |
| 2010/0229778 | A1 * | 9/2010 | Chang | 114/345 |

OTHER PUBLICATIONS

Wing Inflatables, Ihttp:www.wing.com/sponsons-tubes-collars.php , Internet Publication.

* cited by examiner

*Primary Examiner* — Lars A Olson
*Assistant Examiner* — Jovon Hayes
(74) *Attorney, Agent, or Firm* — Dave A. Ghatt

(57) ABSTRACT

A watercraft having a changeable hull structure. More particularly, a watercraft having a first subassembly and one or more second subassemblies. The first subassembly includes a sponson, a flooring, and a transom, the one or more second subassemblies, each being a replaceable hull structure. The first subassembly and each of the one or more second subassemblies have commensurate shapes allowing for attachment and/or replacement of the one or more replaceable hull structures. The watercraft also includes one or more elongated connectors are used to attach the first and second subassemblies.

11 Claims, 7 Drawing Sheets

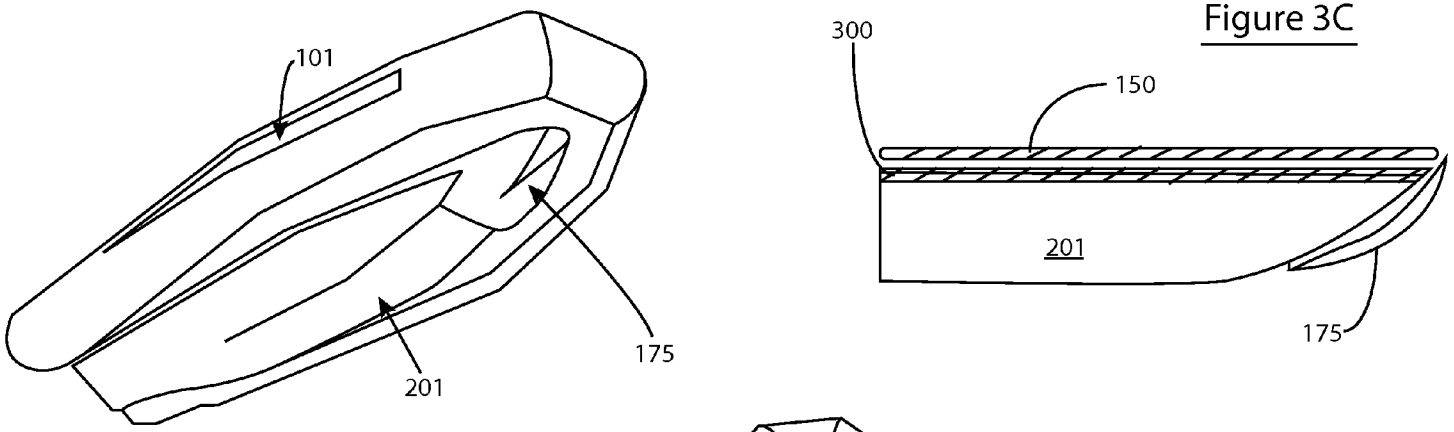
Figure 3A
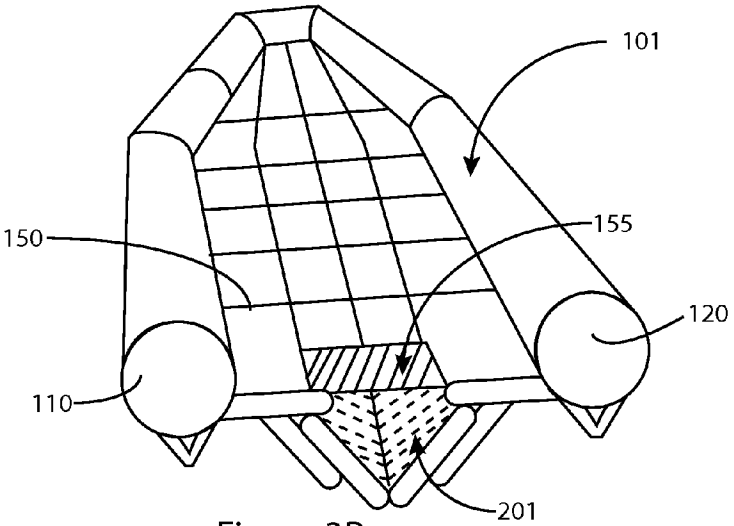
Figure 3B
Figure 3C

WATERCRAFT WITH INTERCHANGEABLE HULL STRUCTURE

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a watercraft having a replaceable hull structure. More particularly, a watercraft having a first subassembly and one or more second subassemblies. The first subassembly and each of the one or more second subassemblies have commensurate shapes allowing for attachment and/or replacement of the one or more replaceable hull structures.

BACKGROUND

Current watercraft designs are fixed and fabricated by manufacturers. Different mission scenarios require different craft capabilities in order to maximize performance. Different mission scenarios may require different payloads, hull forms, structures, materials or propulsion systems. Typically, in order to alter a craft's performance, substantial manufacturing modifications are necessary. This task is made more difficult because one craft alteration to improve a desired characteristic may have adverse effects on other desired characteristics. Thus it is desired to have a watercraft design that accommodates for different mission scenarios without the need for making substantial manufacturing modifications.

SUMMARY

In one aspect, the invention a watercraft having a replaceable hull structure. In this aspect, the watercraft has a first subassembly and a second subassembly. The first subassembly includes a sponson and a flooring attached to the sponson. The flooring has an outer circumferential area defining a substantially V-shaped receiving region. The first subassembly also includes a transom. In this aspect, the second subassembly is a hull structure. The hull structure has a bow end, a stern end, and an upper rim. The upper rim is substantially V-shaped commensurate with the substantially V-shaped receiving region of the first subassembly so that the upper rim matingly attaches at the substantially V-shaped receiving region. The watercraft having the replaceable hull structure also includes one or more elongated connectors. Each elongated connector includes a first elongated connector portion extending on the flooring at the substantially V-shaped receiving region, and a second elongated connector portion extending along the substantially V-shaped upper rim, wherein the first and second elongated connector portions lockingly mate, replaceably attaching the hull structure to the first subassembly.

In another aspect, the invention is a watercraft assembly. The watercraft assembly includes a first subassembly and a plurality of second subassemblies. In this aspect, the first subassembly includes a sponson and a flooring attached to the sponson. The flooring has an outer circumferential area defining a substantially V-shaped receiving region. The first subassembly also includes a transom. In this aspect, each of the plurality of second subassemblies is a replaceable hull structure. Each replaceable hull structure has a bow end, a stern end, and a upper rim. The upper rim is substantially V-shaped commensurate with the substantially V-shaped receiving region of the first subassembly so that the upper rim matingly attaches at the substantially V-shaped receiving region. The watercraft assembly also includes one or more elongated connectors. Each elongated connector has a first elongated connector portion extending on the flooring at the substantially V-shaped receiving region, and a second elongated connector portion extending along the substantially V-shaped upper rim of each of the plurality or replaceable hull structures, wherein the first and second elongated connector portions lockingly mate replaceably attaching one of the plurality of replaceable hull structures to the first subassembly.

BRIEF DESCRIPTION OF THE DRAWINGS

Other features will be apparent from the description, the drawings, and the claims.

FIG. 3A is a perspective illustration showing the second subassembly between the protective cup and the flooring, according to an embodiment of the invention.

FIG. 3B is a perspective illustration showing the second subassembly between the protective cup and the flooring, according to an embodiment of the invention.

FIG. 3C is an exemplary side view illustration, showing the relation of the replaceable hull structure with respect to the flooring and the protective cup, according to an embodiment of the invention.

DETAILED DESCRIPTION

Figure 1A:
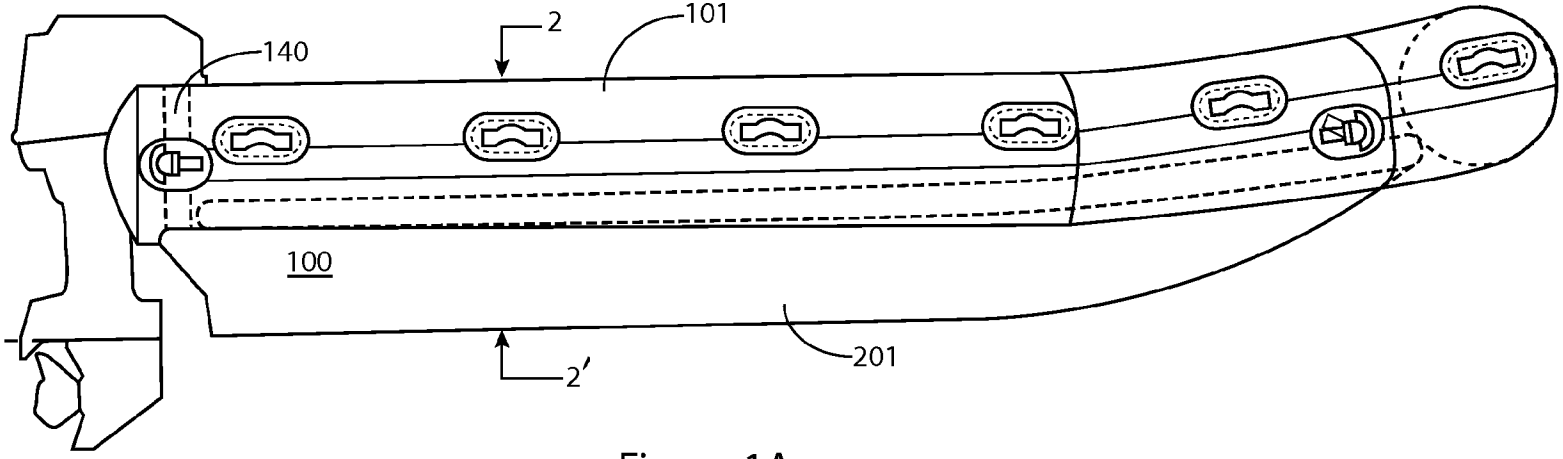
FIG. 1A is an exemplary side view of a watercraft having a first subassembly and a second subassembly, according to an embodiment of the invention.

FIG. 1A is an exemplary side view of an watercraft 100 having a first subassembly 101 and a second subassembly 201, according to an embodiment of the invention. As shown the watercraft 100 includes a first subassembly 101 having a sponson 105, which as outlined below, forms a hull frame. As outlined below, the first subassembly 101 also includes other elements such as flooring (not shown in FIG. 1A) and a transom 140. The watercraft 100 also includes a second subassembly 201, which is replaceable. The second subassembly 201 is essentially a hull structure. The second subassembly or hull structure 201 shown may be replaced by another subassembly 201 that may have different hull characteristics from the one shown in FIG. 1A. As outlined below, the first subassembly 101 and the second subassembly/hull structure 201 have commensurate shapes allowing for attachment and/or replacement of the second subassembly 201 from the first subassembly 101.

Different mission scenarios require different watercraft capabilities in order to optimize performance. According to the invention, the watercraft 100 is designed to accommodate for different mission scenarios without the need for making substantial manufacturing modifications. Different hull structures 201 may be attached to the first subassembly 101 to enable the watercraft 100 to accommodate for the different mission scenarios.

Figure 1B:
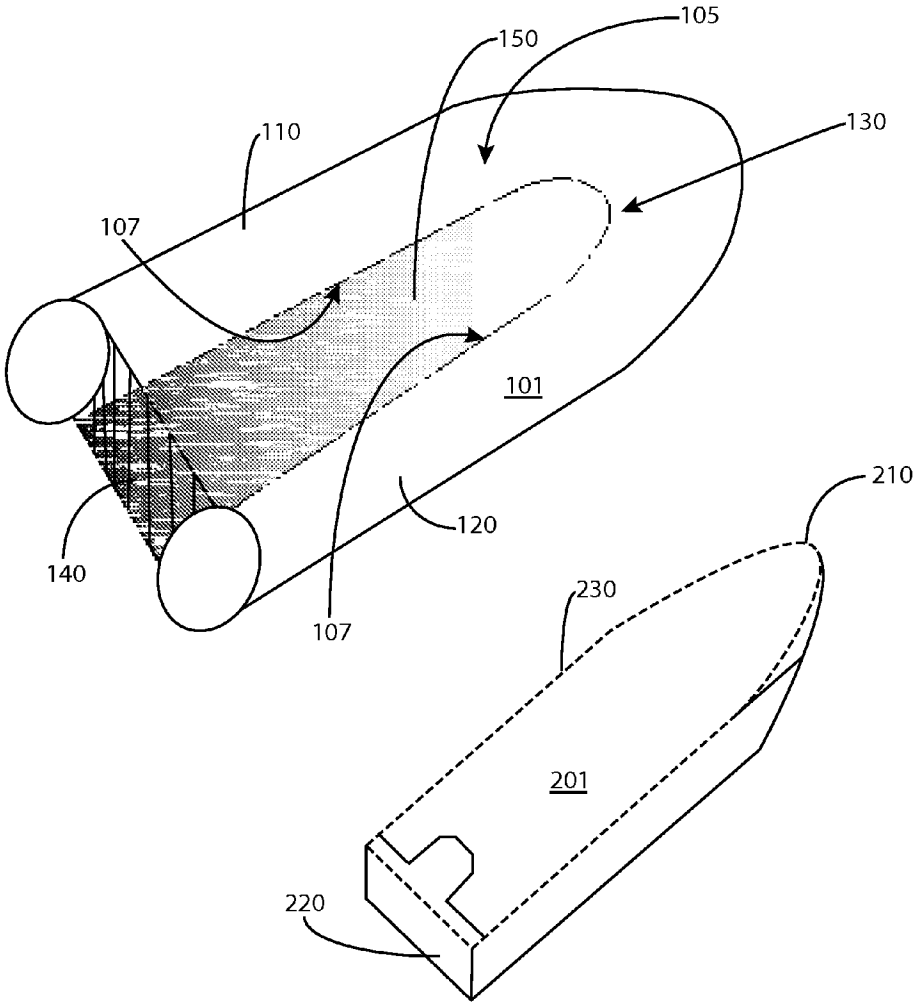
FIG. 1B is an exemplary illustration of a watercraft highlighting the commensurate shapes of the first subassembly and the second subassembly, according to an embodiment of the invention.

FIG. 1B is an exemplary illustration highlighting the commensurate shapes of the first subassembly 101 and the second subassembly/hull structure 201, according to an embodiment of the invention. FIG. 1B only shows the first subassembly 101 and the second subassembly 201 separated from each other. As shown, the first subassembly 101 includes the sponson 105, which is made up of a first elongated arm 110, and a second elongated arm 120. The first and the second elongated arms 110 and 120 intersect forming an apex region 130. As shown the arms 110 and 120 extend outwards from the apex region 130 forming a substantially V-shaped sponson opening. As shown, the first subassembly 101 also includes the flooring 150, which is located within the substantially V-shaped sponson opening. Thus, the flooring 150 is also substantially V-shaped. The flooring is bordered by the first elongated arm 110, the second elongated arm 120, the apex region 130, and the transom 140. As shown, the transom 140 is located at the aft end of the sponson 105, extending from the first arm 110 to the second arm 120.

FIG. 1B also shows a substantially V-shaped receiving region 107 (in dotted lines) for receiving the second subassembly 201. The substantially V-shaped receiving region 107 is defined by an outer circumferential area of the flooring, i.e., the area at which the second subassembly 201 attaches to the flooring 150. It should be understood that the shape of the substantially V-shaped receiving region 107 as described herein, is representative of a plan view, i.e., as viewed from above or below. Additionally, according to embodiments of the invention, the sponson 105, flooring 150 and the substantially V-shaped receiving region 107 may be more rounded and may have a shape that is more akin to a substantially U-shaped opening.

FIG. 1B also shows the second subassembly/hull structure 201. As shown, the replaceable hull structure 201 has a bow end 210 and a stern end 220. The replaceable hull 201 also has a upper rim 230. The upper rim 230 is substantially V-shaped, and as shown is commensurate with the substantially V-shaped receiving region 107. Because of the corresponding substantially V-shapes of the receiving region 107 of the first subassembly 101 and the upper rim 230 of the second subassembly 201, the first and second subassemblies 101 and 201 favorably mate and combine to form the watercraft 100.

Regarding the substantially V-shaped upper rim 230, as with the receiving region 107, it should be understood that the upper rim shape described herein as V-shaped, is representative of a plan view, i.e., as viewed from above. Additionally, according to embodiments of the invention, the apex of substantially V-shaped upper rim 230 may be more rounded and the overall shape may be more akin to being substantially U-shaped. It should also be noted that the shape of the upper rim 230 and the shape of the receiving region 107 are designed to match, so a substantially U-shaped upper rim is commensurate with a substantially U-shaped opening, allowing for a matching connection between the first and second subassemblies 101 and 201.

It should be noted that the watercraft 100 as outlined herein may a solid fixed structure. Alternatively, according to a desired embodiment, the watercraft 100 may be primarily inflatable. Consequently, before and after use, the air may be discharged and the watercraft 100 may be folded-up and stowed in a relatively small container or area, making it an easy asset to transport. According to this embodiment, each of the sponson 105, the flooring 150, and the hull structure 201 is inflatable and made from a coated fabric material. The fabric may be, for example, nylon, polyester, or the like. The fabric may also be made from materials such as Kevlar®, Vectran®, or the like, or combinations of the above listed materials. The fabric may be coated with natural rubber, neoprene rubber, chlorosulfanated-polyethylene material, or the like. Unlike the other elements, the transom 140 may be made from any desired rigid material of fixed-shape, such as a metal or polymer, for example.

Figure 2A:
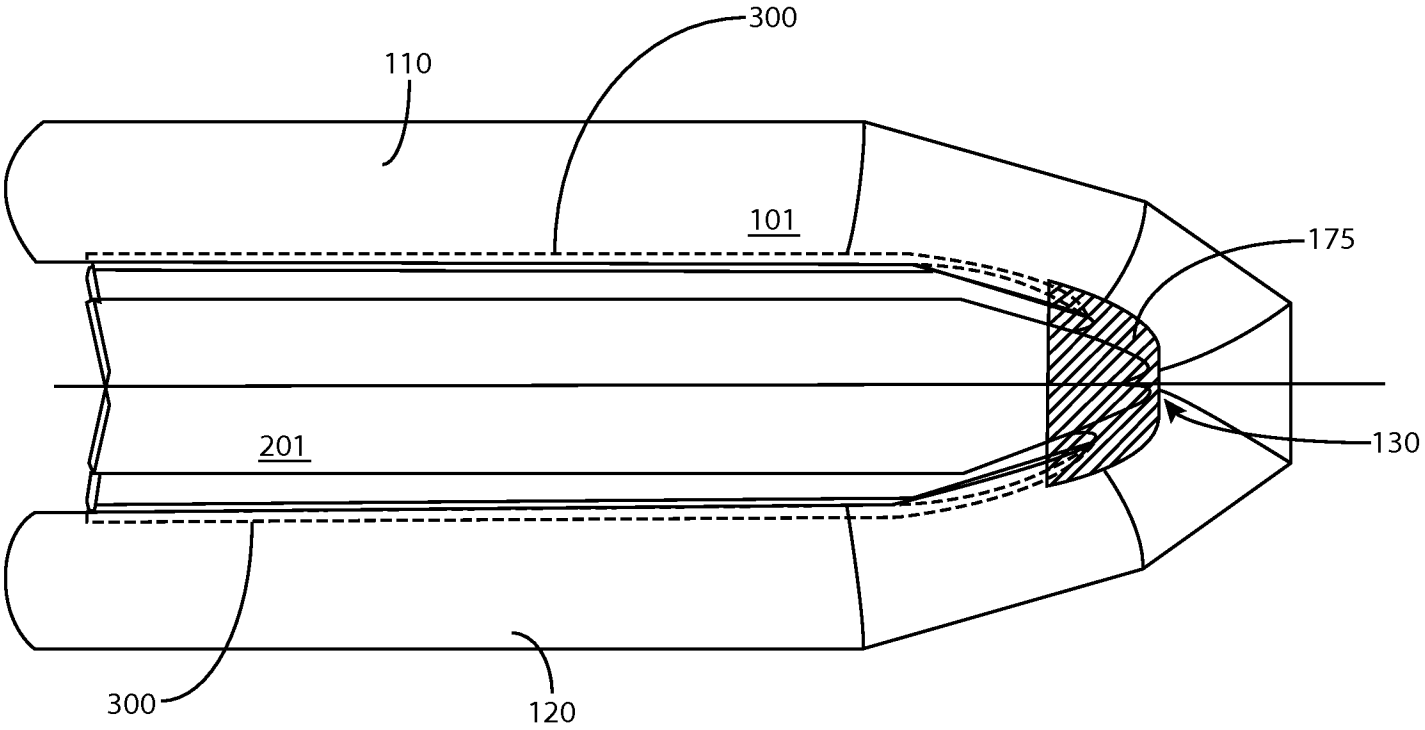
FIG. 2A is an exemplary bottom view of the watercraft 100 showing elongated connectors for attaching the first subassembly to the second subassembly, according to an embodiment of the invention.

FIG. 2A is an exemplary bottom view of the watercraft 100 showing elongated connectors 300 for attaching the first subassembly 101 to the second subassembly/hull structure 201, according to an embodiment of the invention. FIG. 2A shows two elongated connectors 300. Each of the two elongated connectors 300 is a two-part device, with a first elongated connector portion extending along an outer circumferential portion of the flooring 150 (adjacent to one of the elongated arms 110 or 120) and a second elongated connector portion extending along the upper rim 230 of the replaceable hull structure 201. According to the invention, the first and second elongated connector portions lockingly mate, replaceably attaching the hull structure/second subassembly 201 to the first subassembly 101.

FIG. 2A also shows the first subassembly 101 having a protective cup 175 in the apex region 130 of the sponson. The protective cup 175 is provided to protect the bow end 210 of the replaceable hull structure 201. FIG. 2A also shows the first subassembly 101 having the transom 140 at the aft end of the arms 110 and 120, extending from one arm 110 to the other arm 120.

Figure 2B:
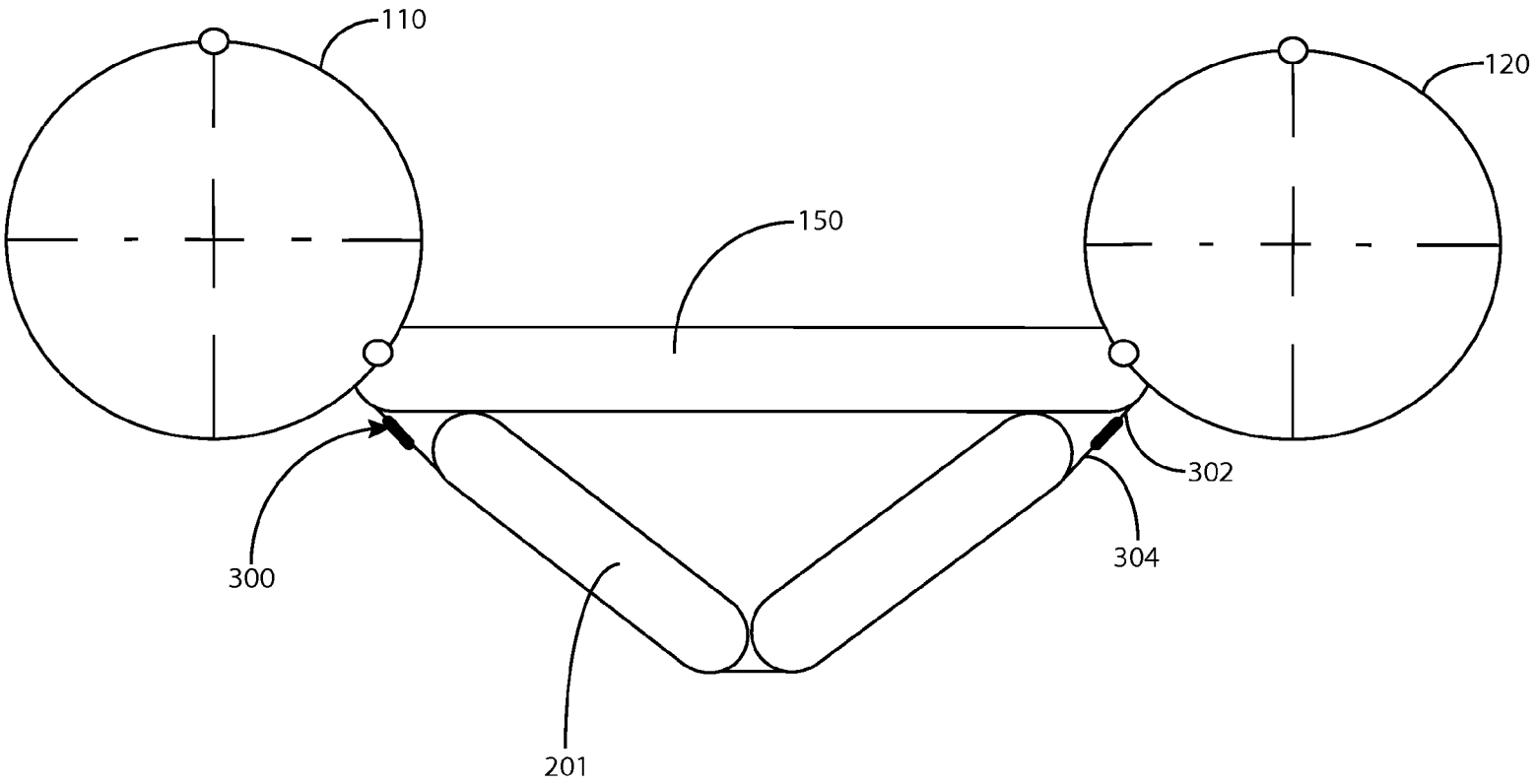
FIG. 2B is an exemplary sectional view through 2-2' of FIG. 1A, showing the watercraft and the elongated connectors for attaching the first subassembly to the second subassembly, according to an embodiment of the invention.

FIG. 2B is an exemplary sectional view through 2-2' of FIG. 1A, showing the watercraft 100 and the elongated connectors 300 for attaching the first subassembly 101 to the second subassembly/hull structure 201, according to an embodiment of the invention. The section view shows the first and the second elongated arms 110 and 120 of the sponson 105. FIG. 2B also shows the first subassembly 101 having a flooring 150 bordered by the first elongated arm 110, the second elongated arm 120, and the rigid transom 140 (shown in dotted lines).

FIG. 2B shows each elongated connector 300 having a first elongated connector portion 302 and a second elongated connector portion 304. The first elongated connector portion 302 is positioned at an outer circumferential area of the flooring 150, in an area adjacent to one of the sponson arms 110 or 120. This is also at the receiver region 107. The second elongated connector portion 304 extends along the substantially V-shaped upper rim. The first and second elongated connector portions 302 and 304 lock to replaceably attach the replaceable hull 201 to the first subassembly 101. Each elongated connector 300 may be a hook and loop arrangement or may be a zipper arrangement. In embodiments in which the elongated connector 300 is a zipper, the elongated connector portions 302 and 304 are mating zipper portions.

Figure 2C:
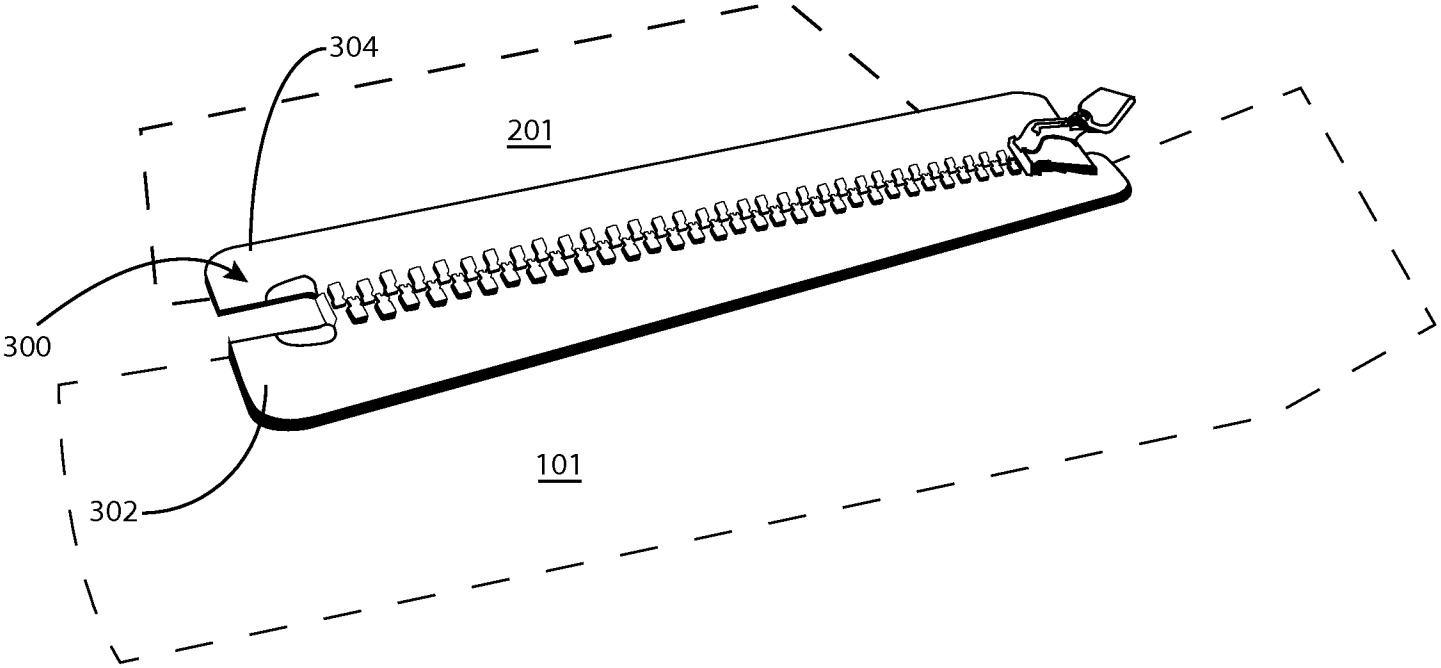
FIG. 2C is an exemplary illustration of an elongated zipper attaching the first subassembly to the second subassembly, according to an embodiment of the invention.

FIG. 2C is an exemplary illustration of an elongated zipper 300, according to an embodiment of the invention. FIG. 2C also shows cut-off portions of the first subassembly 101 and the second subassembly/replaceable hull structure 201. According to this embodiment, the zipper 300 is made from reinforced fabrics and is strong enough to withstand about a 2500 lb./ft. separation load. It should be noted that the elongated connectors 300 are positioned at the substantially V-shaped receiving region 107 at the inside portions of the sponson, thereby protecting the connector portions 302 and 304 when the vessel 100 is in operation, and providing a sturdy connection between the first subassembly 101 and the second subassembly/replaceable hull 201. Additionally, as outlined below, the elongated connectors 300 are further protected by the protection cup 175, which covers the front end of the elongated connectors 300.

FIGS. 3A and 3B are perspective illustrations to show how second subassembly/hull structure 201 fits between the protective cup 175 and the flooring 150 of the first subassembly 101, according to an embodiment of the invention. FIG. 3A shows a perspective view from below the watercraft 100. FIG. 3A shows the replaceable hull structure 201 attached within the substantially V-shaped receiving region 107. FIG. 3A shows the bow end 210 of the replaceable hull structure 201 tucked in the protective cup 175 at the apex region 130, so that the protective cup 175 covers the bow end 210 at the bottom. Returning to FIG. 2A, as shown the protective cup 175 covers the front end of the connectors 300, which protect the connecter 300 from spray or damage when the watercraft 100 is traveling at operational speeds.

FIG. 3B shows a perspective view from above the watercraft 100, with the transom 140 removed. FIG. 3B shows sponson 105 including the first elongated arm 110, the second elongated arm 120, and the apex region 130. As shown, the flooring 150 extends from the first elongated arm 110 to the second elongated arm 120 within the substantially V-shaped opening within the sponson 105, defining the shape of the flooring 150. The watercraft 100 may include a hole 155 in the flooring 150 near the transom, (removed from the view) allowing for access to the valves for filling inflatable hull panels with air, and also allows water to drain freely. According to an embodiment of the invention, a net may be stretched over the opening 155.

FIG. 3B also shows the replaceable hull structure 201 attached to the first subassembly 101 at a location below the flooring 150. Thus, the hull structure 201 is positioned between the flooring 150 and the protective cup 175. This is more clearly illustrated in FIG. 3C. FIG. 3C is an exemplary side view illustration, showing the relation of the replaceable hull structure 201 with respect to the flooring 150 and the protective cup 175. The side view shows the bow end 210 of the replaceable hull 201, tucked between the flooring 150 and the protective cup 175. The protective cup 175 in particular, and also the flooring 150 above provide a pocket for the bow end 210 of the hull to tuck up into, thereby providing a smooth faired shape. As stated above, the positioning of the bow end 210 with respect to the protective cup 175 hides the forward ends of the connectors 300, protecting the connection from damage and spray when the watercraft 100 is in operation.

Figure 4A:
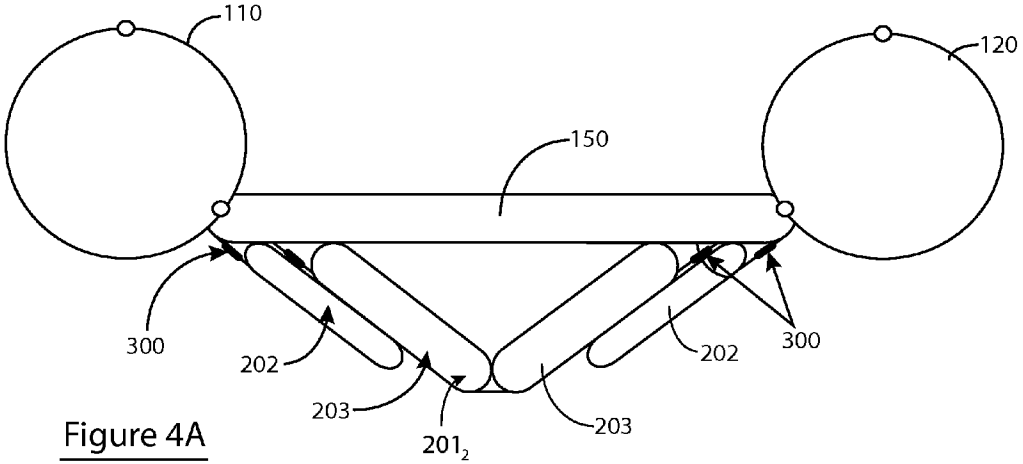
FIG. 4A is an exemplary sectional illustration showing the watercraft with an alternative replaceable hull structure, according to an embodiment of the invention.
Figure 4B:
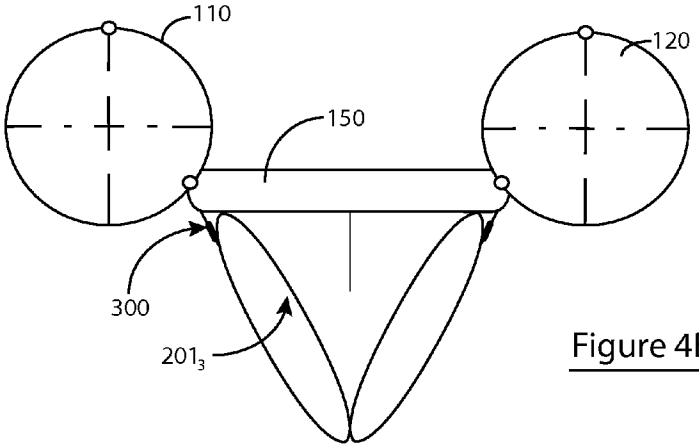
FIG. 4B is an exemplary sectional illustration showing the watercraft with an alternative replaceable hull structure, according to an embodiment of the invention.

FIGS. 4A and 4B are exemplary sectional illustrations, similar to that of FIG. 2B, showing the watercraft 100 having different optional replaceable second subassemblies/hull structures $\mathbf{201}_2$ and $\mathbf{201}_3$, according to embodiments of the invention. As outlined above the watercraft 100 includes a first subassembly 101 and a second subassembly/replaceable hull structure 201. The elongated connectors 300 are used to attach the first subassembly 101 to the second subassemblies. The hull structure 201 (shown in FIG. 2B) may be replaced by other hull structures that have different hull characteristics from the one shown in FIG. 2B. The specific hull structure may be selected to optimize functionality according to specific mission requirements. However, regardless of the particular replaceable hull structure used, the first subassembly 101 and second subassembly/replaceable hull structure 201 have commensurate shapes allowing for attachment and/or replacement of the replaceable hull structures 201 to or from the first subassembly 101.

FIG. 4A shows a watercraft 100 having a replaceable hull structure $\mathbf{201}_2$ connected to the first subassembly 101. FIG. 4A shows flooring 150 extending from the first elongated arm 110 to the second elongated arm 120. As shown, the replaceable hull structure $\mathbf{201}_2$ is double paneled, with outer panels 202 and inner panels 203, which provide a sturdier hull. Although not shown in FIG. 4A, the first subassembly 101 includes protective cup 175 in the apex region 130.

According to this embodiment, two pairs of elongated connectors 300 attach the replaceable second subassembly/hull structure $\mathbf{201}_2$ to the first subassembly 101. As shown, there is a first pair of elongated connectors 300 connecting the outer panels 202 to the flooring 150 or directly to the sponson 105, and a second pair of elongated connectors 300 connecting the inner panels 203 to the flooring 150. The two sets of elongated connectors fortify the attachment with the double paneled hull structure $\mathbf{201}_2$. A first pair of elongated connectors 300 connect the outer panels 202 to the first subassembly 101, and a second elongated connectors 300 connect the inner panels 203 to the first subassembly 101. As shown, the elongated connectors may attach the panels (202, 203) to the flooring 150. As outlined above, each elongated connector 300 may be a zipper as shown in FIG. 2C or a hook and loop arrangement. Similar to the illustration of FIG. 3A, the replaceable hull structure includes a bow 210 and a stern 220, and the bow 110 is tucked in at the protective cup 175, which protects the bow 210 and the front end of the elongated connectors 300.

FIG. 4B shows a watercraft 100 having a replaceable hull structures $\mathbf{201}_3$ connected to the first subassembly 101. FIG. 4B shows flooring 150 extending from the first elongated arm 110 to the second elongated arm 120. The replaceable hull structure $\mathbf{201}_3$ has a greater draft as compared to hull structures 201 and $\mathbf{201}_2$, which makes it more suitable for rough water conditions? As outlined above, the elongated connector may be a zipper as shown in FIG. 2C or a hook and loop arrangement. It should be noted that although the description outline three different hull structures as shown in FIGS. 2B, 4A, and 4B, other hull structures having different shapes or dimensions may be used so long as the first and second subassemblies (101 and 201) have commensurate shapes. As stated above different mission scenarios require different watercraft capabilities in order to optimize performance.

It should be noted that the watercrafts 100 of FIGS. 4A and 4B have the same general material characteristics as outlined above with respect to the embodiments of FIG. 1A-3C. Thus the watercrafts 100 may be a solid fixed structure. According to a desired embodiment, the watercrafts 100 shown in FIGS. 4A and 4B may be primarily inflatable. According to this embodiment, each of the sponson 105, the flooring 150, and the hull structures $\mathbf{201}_2$ and $\mathbf{201}_3$ are inflatable and made from a coated fabric material. The fabric may be, for example, nylon, polyester, or the like. The fabric may also be made from materials such as Kevlar®, Vectran®, or the like, or combinations of the above listed materials. The fabric may be coated with natural rubber, neoprene rubber, chlorosulfanated-polyethylene material, or the like. Unlike the other elements, the transom 140 may be made from any desired rigid material of fixed-shape, such as a metal or polymer, for example.

What has been described and illustrated herein are preferred embodiments of the invention along with some variations. The terms, descriptions and figures used herein are set forth by way of illustration only and are not meant as limitations. For example, as outlined above, the substantially V-shapes of the opening 107 and the upper rim may have respective rounded apexes, and thus have respective shapes that are more akin to substantially U-shapes. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A watercraft having a replaceable hull structure comprising:

a first subassembly comprising:

a sponson;

a flooring attached to the sponson, the flooring having an outer circumferential area defining a substantially V-shaped receiving region; and a transom;

a second subassembly, wherein the second subassembly is a hull structure comprising;

a bow end;

a stern end; and an upper rim, wherein the upper rim is substantially V-shaped commensurate with the substantially V-shaped receiving region of the first subassembly so that the upper rim matingly attaches at the substantially V-shaped receiving region; and one or more elongated connectors, each elongated connector comprising:

a first elongated connector portion extending on the flooring at the substantially V-shaped receiving region; and a second elongated connector portion extending along the substantially V-shaped upper rim, wherein the first and second elongated connector portions lockingly mate, replaceably attaching the hull structure to the first subassembly.

2. The watercraft of claim 1, wherein each elongated connector comprises one of a zipper, or a hook and loop assembly.

3. The watercraft of claim 2, wherein the first subassembly further comprises a protective cup, wherein the sponson comprises a first elongated arm and a second elongated arm, wherein the first and the second elongated arms intersect forming an apex region, wherein the protective cup is positioned in the apex region for protecting the bow end of the hull structure, and wherein the flooring is bordered by the first elongated arm, the second elongated arm, the apex region, and the transom, wherein the hull structure attached at the substantially V-shaped receiving region is positioned below the flooring, and wherein the bow end of the hull structure is tucked between the flooring and the protective cup.

4. The watercraft of claim 3, wherein each of the sponson, the flooring, and the hull structure is inflatable and made from a coated fabric material, and wherein the transom is made from a rigid material of fixed-shape.

5. The watercraft of claim 3, wherein the hull structure is double paneled, comprising outer panels and inner panels, and wherein the one or more elongated connectors comprise a first pair of elongated connectors connecting the outer panels to the flooring, and a second pair of elongated connectors connecting the inner panels to the flooring.

6. A watercraft assembly comprising:

a first subassembly comprising:

a sponson;

a flooring attached to the sponson, the flooring having an outer circumferential area defining a substantially V-shaped receiving region; and a transom;

a plurality of second subassemblies, wherein each of the plurality of subassemblies is a replaceable hull structure comprising:

a bow end;

a stem end; and an upper rim, wherein the upper rim is substantially V-shaped commensurate with the substantially V-shaped receiving region of the first subassembly so that the upper rim matingly attaches at the substantially V-shaped receiving region; and one or more elongated connectors, each elongated connector comprising:

a first elongated connector portion extending on the flooring at the substantially V-shaped receiving region; and a second elongated connector portion extending along the substantially V-shaped upper rim of each of the plurality or replaceable hull structures, wherein the first and second elongated connector portions lockingly mate replaceably attaching one of said plurality of replaceable hull structures to the first subassembly.

7. The watercraft assembly of claim 6, wherein each elongated connector comprises one of a zipper, or a hook and loop assembly.

8. The watercraft assembly of claim 7, wherein the first subassembly further comprises a protective cup, wherein the sponson comprises a first elongated arm and a second elongated arm, wherein the first and the second elongated arms intersect forming an apex region, wherein the protective cup is positioned in the apex region for protecting the bow end of an attached hull structure of said plurality of replaceable hull structures, and wherein the flooring is bordered by the first elongated arm, the second elongated arm, the apex region, and the transom, wherein the attached hull structure at the substantially V-shaped receiving region is positioned below the flooring, and wherein the bow end of the attached hull structure is tucked between the flooring and the protective cup.

9. The watercraft assembly of claim 8, wherein the dimensions of at least one of the plurality of replaceable hull structures is different from the dimensions of at least one other of the plurality of replaceable hull structures.

10. The watercraft assembly of claim 9, wherein one of the plurality of replaceable hull structures is double paneled, comprising outer panels and inner panels, and wherein the one or more elongated connectors comprise a first pair of elongated connectors connecting the outer panels to the flooring, and a second pair of elongated connectors connecting the inner panels to the flooring.

11. The watercraft assembly of claim 10, wherein in the first subassembly, each of the sponson and the flooring is inflatable and made from a coated fabric material, and the transom is made from a rigid material, and wherein in each of the plurality of subassemblies the hull structure is inflatable and made from a coated fabric material.

* * * * *